US007178960B2

(12) United States Patent
Ishida

(10) Patent No.: US 7,178,960 B2
(45) Date of Patent: Feb. 20, 2007

(54) VEHICULAR ILLUMINATION LAMP

(75) Inventor: Hiroyuki Ishida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/296,409

(22) Filed: Dec. 8, 2005

(65) Prior Publication Data

US 2006/0126353 A1 Jun. 15, 2006

(30) Foreign Application Priority Data

Dec. 9, 2004 (JP) ..... P.2004-357459

(51) Int. Cl.
*F21V 101/10* (2006.01)

(52) U.S. Cl. ..... 362/545; 362/517; 362/518; 362/543; 362/298; 362/297; 362/346

(58) Field of Classification Search ..... 362/517, 362/518, 516, 507, 543, 544, 545, 247, 298, 362/297, 346
See application file for complete search history.

(56) References Cited

U.S. PATENT DOCUMENTS 6,234,646 B1 * 5/2001 Ito ..... 362/235
2004/0120160 A1 * 6/2004 Natsume ..... 362/544
2006/0087860 A1 * 4/2006 Ishida ..... 362/517
2006/0120094 A1 * 6/2006 Tsukamoto et al. ..... 362/518

FOREIGN PATENT DOCUMENTS

JP 2003-317513 A 11/2003

* cited by examiner

*Primary Examiner*—Laura K. Tso
(74) *Attorney, Agent, or Firm*—Sughrue Mion, PLLC

(57) ABSTRACT

A vehicular illumination lamp, including four light emitting devices 12 which are disposed in such a manner as to spread about a predetermined point A as a center, a reflector 14 having four reflecting surfaces 14*a* that are made up of ellipsoids of revolution Er1, which take light emitting centers of the respective light emitting devices 12 and the predetermined point A as primary focal points and secondary focal points thereof, respectively, and a light distribution control member 16, which controls the light distribution of light from the respective light emitting devices 12 that is reflected on the reflector 14 so as to cause the light so controlled to traverse to a front of the lamp, whereby light emitted from the respective light emitting devices 12 is made first to be reflected on the respective reflecting surfaces 14*a* and is then caused to converge on the predetermined point A.

18 Claims, 10 Drawing Sheets

VEHICULAR ILLUMINATION LAMP

This application claims foreign priority from Japanese Patent Application No. 2004-357459, filed Dec. 9, 2004, the entire disclosure of which is herein incorporated by reference.

BACKGROUND OF THE INVENTION

1. Field of the Invention

The present invention relates to a vehicular illumination lamp that utilizes a light emitting device as a light source.

2. Related Art

In recent years, vehicular illumination lamps, which utilize light emitting devices such as light emitting diodes as light sources, have been proposed for adoption as headlamps or the like.

For example, Japanese Patent Publication No. 2003-317513 ("JP '513") describes a so-called projector type vehicular illumination lamp, which includes a projection lens disposed on an optical axis which extends in a longitudinal direction of the lamp and a light source unit disposed rearwards of the projection lens. The light source unit of the vehicular illumination lamp described in JP '513 is configured so as to include a light emitting device disposed near the optical axis at a position situated further rearwards than a rear focal point of the projection lens, and a reflector disposed in such a manner as to cover the light emitting device from thereabove so as to reflect light from the light emitting device towards a front of the lamp while causing the light to get closer to the optical axis. Then, a light distribution pattern is formed as an inversely projected image of a light source image that is formed on a rear focal plane of the projection lens, when the light source unit is turned on.

When adopting a lamp configuration such as that described in the aforesaid JP '513, it is possible to form a predetermined light distribution pattern while enhancing the utilization factor of a bundle of rays of light from a light emitting device.

In the vehicular illumination lamp described in the aforesaid JP '513, however, since the light source is made up of the single light emitting device, there is a limitation on the brightness of a light distribution pattern that is formed by light emitted from the light source, even if the utilization factor of a bundle of rays of light emitted from the light emitting device is enhanced to a maximum level. Consequently, in a case where this vehicular illumination lamp is used as a lamp unit for a headlamp, there is a problem that many such lamp units are necessary.

The invention was made in the light of these situations, and an object thereof is to provide an vehicular illumination lamp utilizing a light emitting device as a light source which can secure a sufficient brightness for a light distribution pattern that is formed by light emitted thereof.

SUMMARY OF THE INVENTION

According to the invention, a vehicular illumination lamp includes a plurality of light emitting devices, which are disposed in such a manner as to spread about a predetermined point as a center; a reflector having a plurality of reflecting surfaces which are made up of ellipsoids of revolution which take points near the respective light emitting devices and the predetermined point as primary focal points and secondary focal points thereof, respectively; and a light distribution control member for controlling the light distribution of light from the respective light emitting devices that is reflected on the reflector so as to cause the light so controlled to traverse to a front of the lamp.

There is no specific limitation on the type of the vehicular illumination lamp, and hence the vehicular illumination lamp can be adopted as, for example, a headlamp, a fog lamp, a cornering lamp and a daytime running lamp or as a lamp unit which makes up those lamps.

The light emitting device can be a device-like light source having a light emitting chip which emits light substantially in the form of a spot, and there is no specific limitation on the type thereof. For example, light emitting diodes, laser diodes and the like can be adopted.

There is no specific limitation on the number and a specific arrangement of the plurality of light emitting devices, For example, circumferential intervals between the respective light emitting devices may be or may not be set to an equal value. However, if the plurality of light emitting devices are disposed around a circumference of an axis which passes through a predetermined center point at substantially equal intervals with respect to the axis, the respective reflecting surfaces can be formed into substantially the same shape of the same size, and the utilization factor of bundles of rays of light from the plurality of light emitting devices can be enhanced.

There is no specific limitation on a specific configuration of the light distribution control member. For example, the light distribution control member can be made up of a reflector, a lens or a combination of a reflector and a lens.

Since the light distribution control member can control the light distribution of light from the respective light emitting devices that is reflected on the reflector as diffused light from the predetermined point, a sufficient brightness can be secured for a light distribution pattern that is formed by light emitted from the vehicular illumination lamp. Moreover, as this occurs, the light distribution control can be implemented with good accuracy. By adopting this configuration, the number of such vehicular illumination lamps required when the vehicular illumination lamp of the invention is attempted to be used as a headlamp can be reduced.

BRIEF DESCRIPTION OF THE DRAWINGS

The advantages, nature and various additional features of the invention will appear more fully upon consideration of the exemplary embodiment of the invention, which is schematically set forth in the drawings, in which.

DETAILED DESCRIPTION OF THE EXEMPLARY EMBODIMENT

Although the invention will be described below with reference to an exemplary embodiment and modifications thereof, the following exemplary embodiment and modifications do not restrict the invention.

Figure 1:
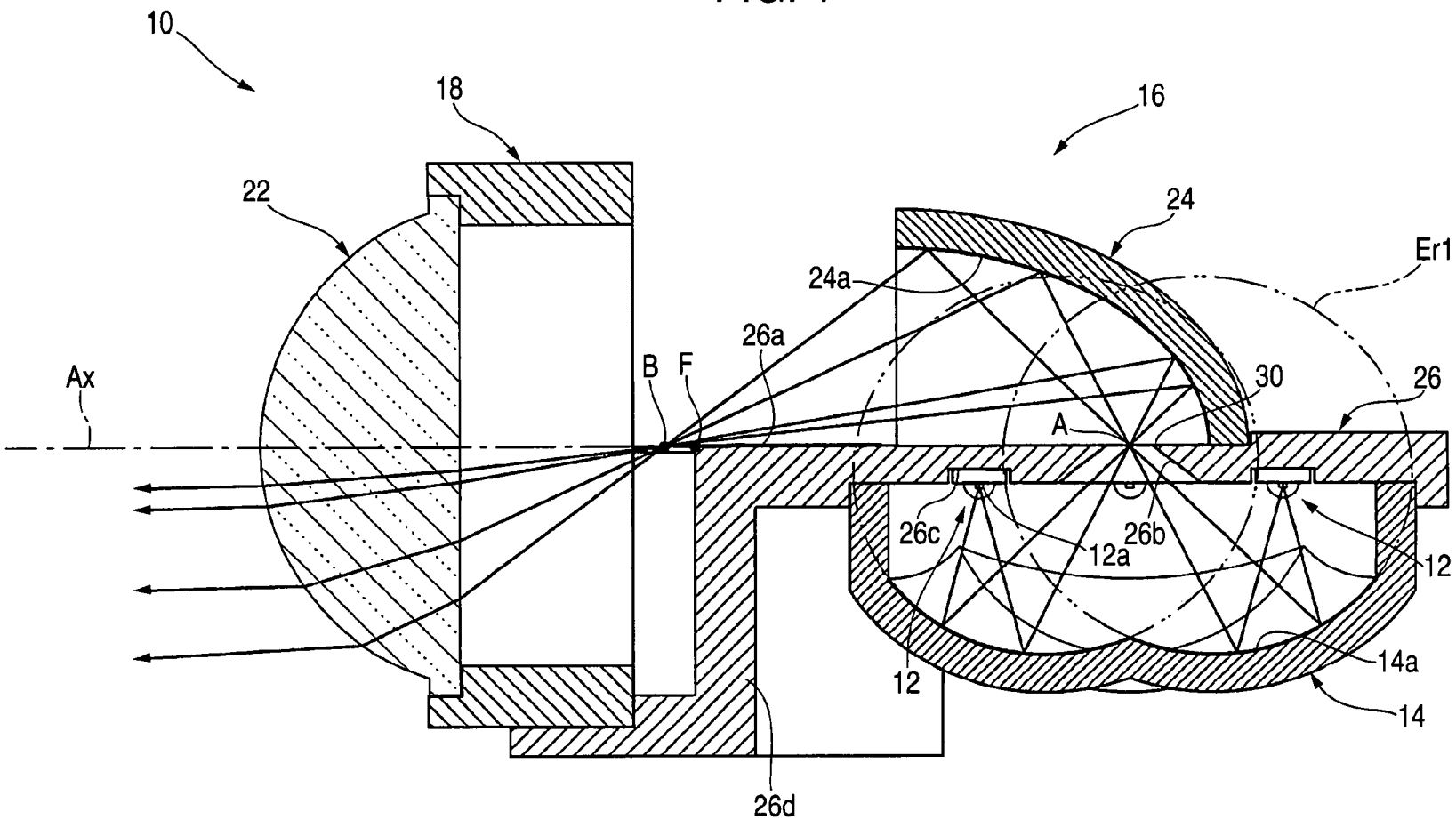
FIG. 1 is a side sectional view which shows a vehicular illumination lamp according to an exemplary embodiment of the invention.
Figure 2:
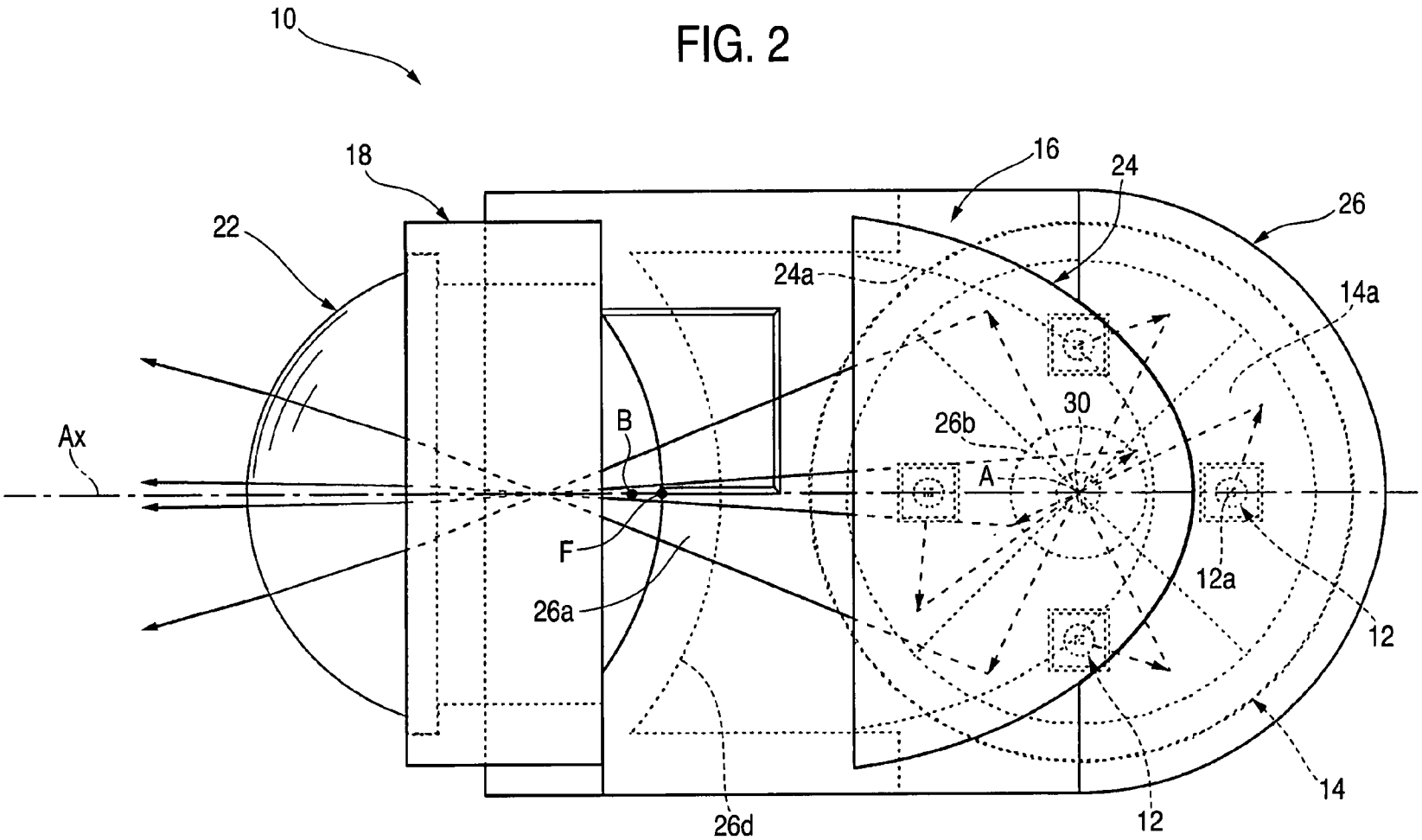
FIG. 2 is a plan view which shows the vehicular illumination lamp.
Figure 3:
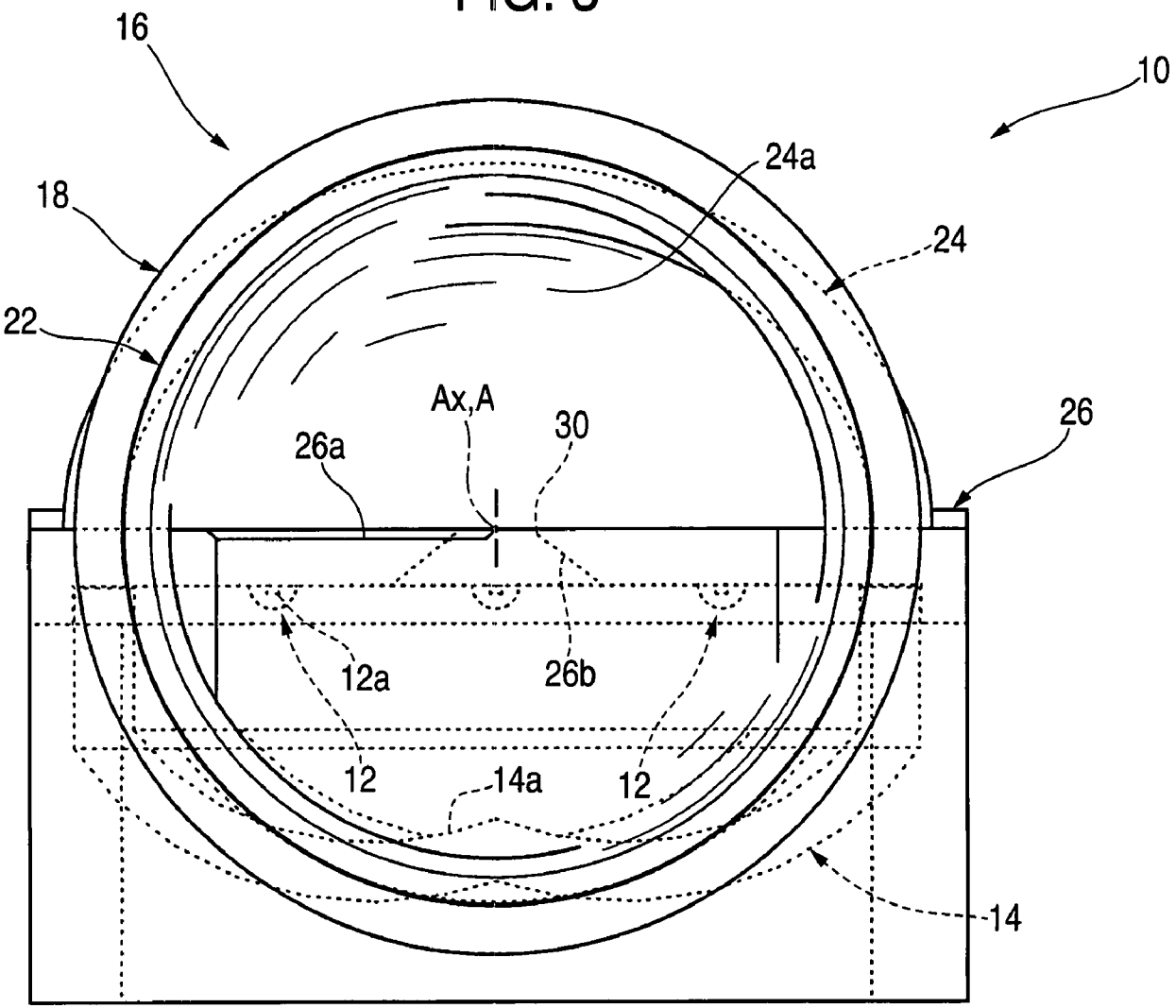
FIG. 3 is a front view which shows the vehicular illumination lamp.

FIG. 1 is a side sectional view which shows a vehicular illumination lamp 10 according to an exemplary embodiment of the invention. FIGS. 2 and 3 are a plan view and a front view thereof, respectively.

As shown in these figures, this vehicular illumination lamp 10 includes four light emitting devices 12, a reflector 14, and a light distribution control member 16. The four light emitting devices 12 are disposed around a predetermined center point A and lie on an optical axis Ax, which extends along a longitudinal direction of the lamp. The reflector 14 reflects light upwards from these respective light emitting devices 12. The light distribution control member 16 controls the distribution of light from the respective light emitting devices 12 that is reflected on the reflector 14 so as to cause the light so controlled to travel to a front of the lamp.

This vehicular illumination lamp 10 is a lamp unit, which is incorporated as part of a headlamp. When incorporated in the headlamp, the vehicular illumination lamp 10 is disposed in such a state that the optical axis Ax thereof extends in a downward direction at an angle of about 0.5 to 0.6° relative to a longitudinal direction of a vehicle.

The four light emitting devices 12 are disposed on a same circumference, which is centered at a vertical axis which passes through the predetermined point A, at intervals of 90°. In this case, these respective light emitting devices 12 are disposed at positions that are slightly below a horizontal plane which contains the predetermined point A.

The reflector 14 has four reflecting surfaces 14*a*, which are ellipsoids of revolution Er1. The ellipsoids of revolution include light emitting centers of the respective light emitting devices 12 as primary focal points and the predetermined point A as secondary focal points thereof. Then, by this configuration, the reflector 14 is adapted first to cause light from the respective light emitting devices 12 that is reflected on the respective reflecting surfaces 14*a* of the reflector 14 to converge temporarily on the predetermined point A and then to cause the light so converging to emerge upwards from the predetermined point A as diffused light therefrom.

The light distribution control member 16 includes a projection lens 22, an additional reflector 24, and a mirror member 26. The projection lens 22 disposed on the optical axis in such a manner that a rear focal point F lies further forwards than the predetermined point A. The additional reflector 24 is disposed to cover the predetermined point A from above and adapted to reflect light from the respective light emitting devices 12 that is reflected on the reflector 14 towards the front of the lamp, while causing the light so reflected to get closer to the optical axis Ax. The mirror member 26 has an upwardly oriented reflecting surface 26*a*, which extends rearwards from the rear focal point F along the optical axis Ax so as to reflect upwards part of reflected light from the additional reflector 24.

The reflector 14 is fixedly positioned on a lower surface of the mirror member 26. An aperture stop 30 of a predetermined diameter (for example, a diameter of about 5 to 10 mm) is provided between the reflector 14 and the light distribution control member 16 in such a manner as to surround the predetermined point A. This aperture stop 30 is situated on an upper surface of the mirror member 26. An opening 26*b* having the shape of a frustum of circular cone is formed in the mirror member 26 in such a manner as to become wider as it extents downwards from the aperture stop 30.

Each light emitting device 12 is a white light emitting diode having a square light emitting chip 12*a* of a size of about 0.3 to 3 $mm^2$ and is fixedly positioned in a light source support recess portion 26*c* formed in the lower surface of the mirror member 26 in such a state that the light emitting chip 12*a* thereof is disposed so as to be oriented vertically downwards.

Figure 4:
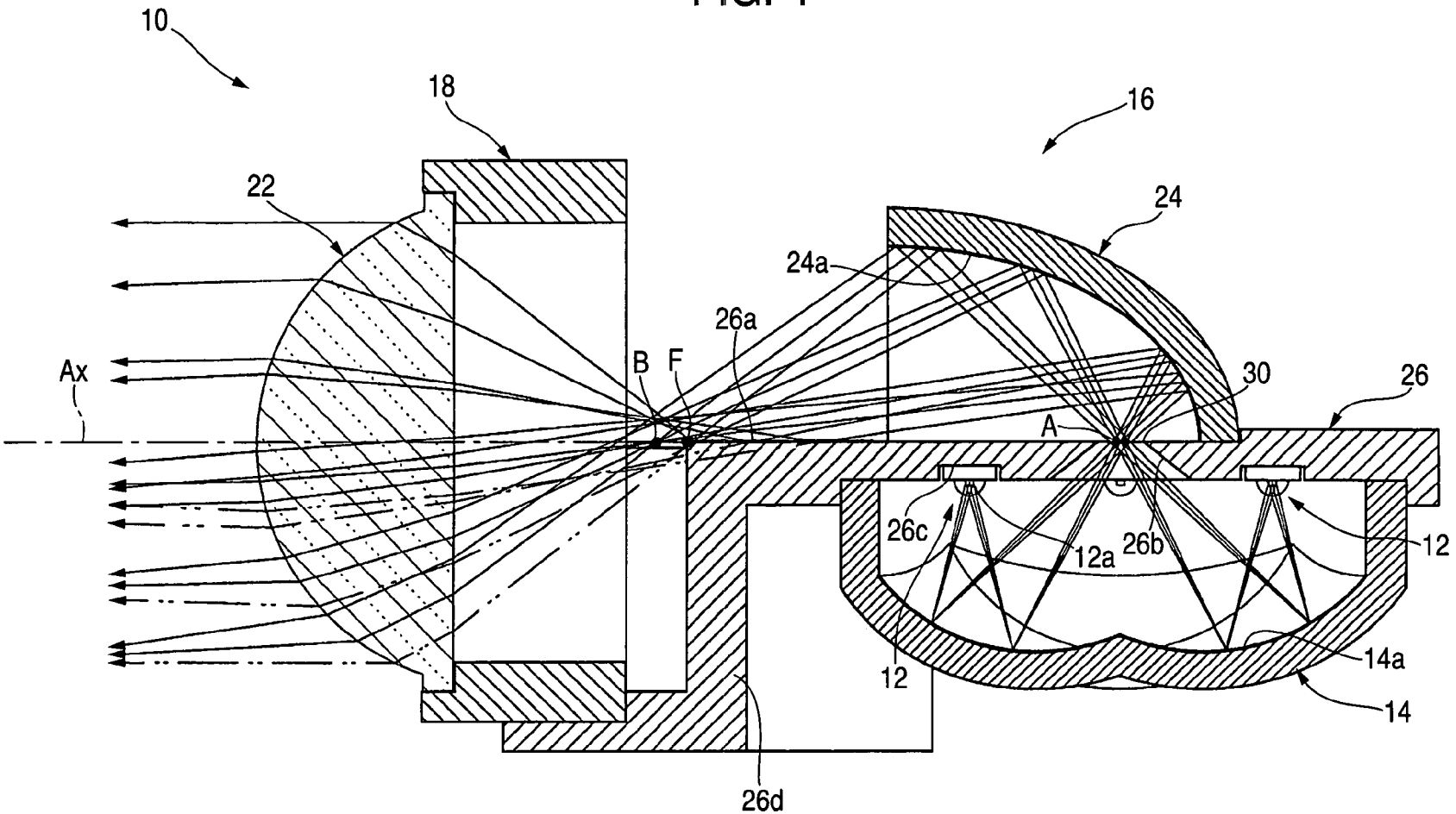
FIG. 4 is a side sectional view which shows the vehicular illumination lamp while paying attention to optical paths of light emitted from respective locations of light emitting chips of respective light emitting devices.

FIG. 4 is a side sectional view which shows the vehicular illumination lamp 10 by paying attention to optical paths of light emitted from respective locations of the light emitting chips 12*a* of the respective light emitting devices 12.

As shown FIG. 4, the projection lens 22 is made up of a planoconvex lens, which is a lens for which a front surface is convex and a rear surface is planar. The projection lens 22 is adapted to project an image on a focal plane on to an imaginary vertical screen ahead of the lamp as an inverted image thereof. The projection lens 12 includes the rear focal point F.

The projection lens 22 is supported on a lens holder 18. Then, this lens holder 18 is supported on a bracket portion 26*d*, which is formed to extend forwards from the mirror member 26.

A reflecting surface 24*a* of the additional reflector 24 is made up of a substantially ellipsoidal surface, which has a major axis that is coaxial with the optical axis Ax and takes the predetermined point A as a primary focal point thereof. In this case, the reflecting surface 24*a* is set such that a vertical sectional shape thereof which extends along the optical axis Ax becomes an elliptic shape which takes, as a secondary focal point, a point B, which lies slightly further forwards than the rear focal point F and also is set such that the eccentricity thereof gradually increases from a vertical section to a horizontal section. Therefore, the additional reflector 24 is adapted not only to cause light from the respective light emitting devices 12 that is reflected on the reflector 14 to converge on the point B within the vertical section but also to move the converging position rather forwards within the horizontal section. This additional reflector 24 is fixed to the upper surface of the mirror member 26 at a lower end portion of a circumferential edge of the reflecting surface 24*a*.

The upwardly oriented reflecting surface 26*a* of the mirror member 26 is formed by applying to the upper surface of the primary mirror member 26 a planishing treatment to provide a mirror reflection effect. The planishing treatment includes the deposition or spray of aluminum. In this upwardly oriented reflecting surface 26*a*, a left-hand side area, which lies further leftwards than the optical axis Ax, is made up of a horizontal plane including the optical axis Ax, whereas a right-hand side area, which lies further rightwards than the optical axis Ax, is made up of a horizontal plane that is made lower by one step than the left-hand side area via a short slope. Then, a front end edge of the upwardly oriented reflecting surface 26*a* is formed in such a manner as to extend along the focal plane containing the rear focal point F, whereby as shown in FIG. 4, the primary mirror member 26 is configured to reflect part of reflected light traveling from the reflecting surface 24*a* of the additional reflector 24 to the projection lens 22 from the upwardly oriented reflecting surface 26*a* thereof to thereby cause the part of the reflected light so reflected to be incident on the projection lens 22. The light incident on the projection lens 22 emerge therefrom as a downwardly oriented light.

Figure 5:
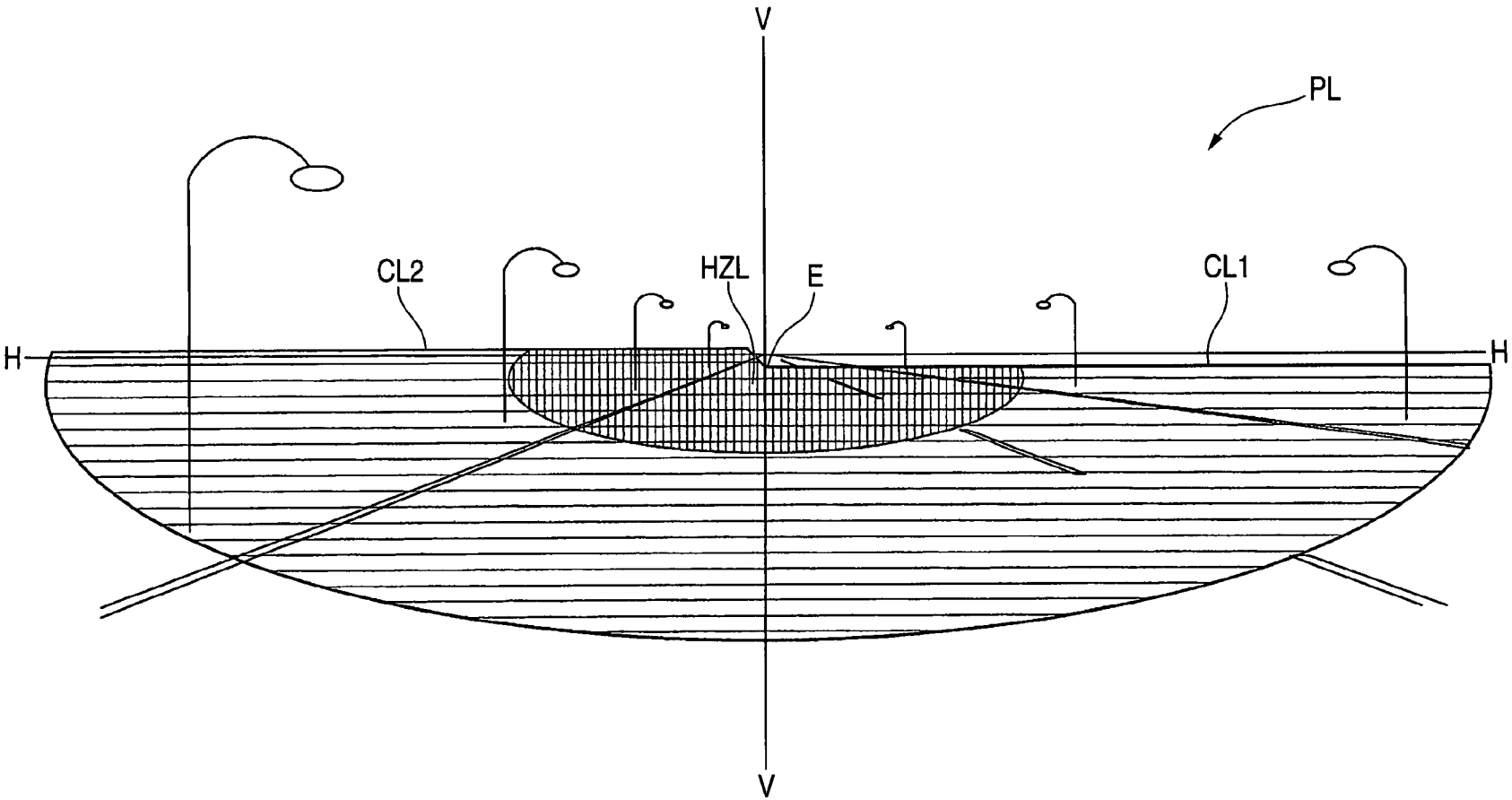
FIG. 5 is a perspective view of a light distribution pattern that is to be formed by light emitted forwards from the vehicular illumination lamp on an imaginary vertical screen disposed 25 m ahead of a vehicle.

FIG. 5 is a perspective view of a light distribution pattern PL, which is formed by light emitted forwards from the vehicular illumination lamp 10 on an imaginary vertical screen disposed 25 m ahead of the vehicle.

As shown in the same figure, this light distribution pattern PL is a lower beam light distribution pattern for the left-hand side traffic where vehicles are driven on the left-hand side of the road and has at an upper end portion thereof cut-off lines CL1, CL2, which are aligned transversely while being staggered vertically in a step-like fashion. These cut-off lines CL1, CL2 extend transversely horizontally while being staggered vertically along a V-V line, as a boundary, which passes vertically through an H-V point, which is a vanishing point lying in a forward direction of the lamp. Therefore, a portion lying further rightwards than the V-V line, which illuminates a lane for oncoming vehicles, is formed as a lower cut-off line CL1, whereas and a portion lying further leftwards than the V-V line, which illuminates a lane for the subject vehicle, is formed as an upper cut-off line CL2, which is raised from the lower cut-off line CL1 to a higher level via an inclined portion.

This lower beam light distribution pattern PL is formed by projecting images of the light emitting devices 12 that are formed on the rear focal plane of the projection lens 22 by light from the light emitting devices 12 that is first reflected on the reflector 14 and then is reflected on the additional reflector 24 on to the imaginary vertical screen as inversely projected images thereof by the projection lens 22. The cut-off lines CL1, CL2 thereof are formed as an inversely projected image of the front end edge of the upwardly oriented reflecting surface 26*a* of the mirror member 26.

In this lower beam light distribution pattern PL, an elbow point E, which is an intersection point between the lower cut-off line CL1 and the V-V line, lies below the H-V point by an angle of about 0.5 to 0.6°. This is because the optical axis Ax extends in the downward direction at the angle of about 0.5 to 0.6° relative to the longitudinal direction of the vehicle. Then, in the lower beam light distribution pattern PL, a hot zone HZL, which constitutes a high luminous intensity area, is formed in such a manner as to surround the elbow point E.

Note that when the vehicular illumination lamp 10 according to the exemplary embodiment of the invention is incorporated in an actual headlamp, a plurality of such vehicular illumination lamps 10 will be incorporated therein, whereby a plurality of lower beam light distribution patterns PL, shown in FIG. 5, are formed in a superposed fashion as a lower beam light distribution pattern of the whole of the headlamp.

Thus, as has been described in detail heretofore, the following functions and advantages can be obtained since the vehicular illumination lamp 10 according to the exemplary embodiment of the invention includes the four light emitting devices 12 that are disposed in such a manner as to spread about the predetermined point A as a center, the reflector 14 having the four reflecting surfaces 14*a* that are made up of the ellipsoids of revolution Er1, which take the light emitting centers of the respective light emitting devices 12 and the predetermined point A as the primary focal points and the secondary focal points thereof, respectively, and the light distribution control member 16 for controlling the light distribution of light from the respective light emitting devices 12 that is reflected on the reflector 14 so as to cause the light so controlled to traverse to the front of the lamp.

Namely, since light emitted from the respective light emitting devices 12 is first reflected on the respective reflecting surfaces 14*a* of the reflector 14, which are made up of the ellipsoids of revolution Er1 that take the light emitting centers of the respective light emitting devices 12 as the primary focal points, and then is caused to converge on the predetermined point A, which is the secondary focal points of the reflecting surfaces, the utilization factor of bundles of rays of light from the four light emitting devices 12 can be enhanced. In addition, since the light distribution control member 16 can control the light distribution of light from the four light emitting devices 12 that is reflected on the reflector 14 as diffused light from the predetermined point A, the brightness of the lower beam light distribution pattern PL formed by light emitted from the vehicular illumination lamp 10 can be secured sufficiently. As this occurs, the light distribution control can be implemented with good accuracy.

Then, by adopting this configuration, a smaller number of such vehicular illumination lamps are required when the vehicular illumination lamp 10 of the exemplary embodiment is used as a headlamp.

In this case, in this exemplary embodiment, the lower beam light distribution pattern PL can be formed as a light distribution pattern, which has the clear cut-off lines CL1, CL2 at the upper end portion thereof; while enhancing the utilization factor of bundles of rays of light from the four light emitting devices 12 since the reflector 14 is disposed in such a manner as to be oriented upwards, the light distribution control member 16 includes the projection lens 22 disposed on the optical axis As in such a manner that the rear focal point F lies further forwards than the predetermined point A, the additional reflector 24 is disposed in such a manner as to cover the predetermined point A from above and is adapted to reflect light from the respective light emitting devices 12 that is reflected on the reflector 14 towards the front of the lamp, while causing the light so reflected to get closer to the optical axis Ax, and the mirror member 26 includes the upwardly oriented reflecting surface 26*a*, which extends rearwards from the rear focal point F along the optical axis Ax so as to reflect upwards part of reflected light from the additional reflector 24.

In addition, in the exemplary embodiment, since the four light emitting devices 12 are disposed on the same circumference centered at the vertical axis which passes through the predetermined point A at intervals of 90°, each reflecting surface 14*a* can be formed into the same shape of the same size, whereby the utilization factor of bundles of rays of light from the four light emitting devices 12 can be enhanced further.

Furthermore, in the exemplary embodiment, since the aperture stop 30 is provided between the reflector 14 and the light distribution control member 16 in such a manner as to surround the predetermined point A, stray light contained in reflected light traveling from the reflector 14 to the light distribution control member 16 can be removed, whereby there can be eliminated a risk that light distribution irregularities are generated at a circumferential edge portion of a light distribution pattern to be formed.

While the exemplary embodiment has been described as having the four light emitting devices 12, a configuration in which there are provided two or three light emitting devices 12 or a configuration in which there are five or more light emitting devices 12 is possible. In this case, it is preferable from the viewpoint of enhancing the utilization factor of bundles of rays of light from the plurality of light emitting devices 12 that these light emitting devices 12 are made to be disposed on the same circumference centered at the vertical axis which passes through the predetermined point A at equal distances.

Next, modifications to the exemplary embodiment will be described.

Figure 6:
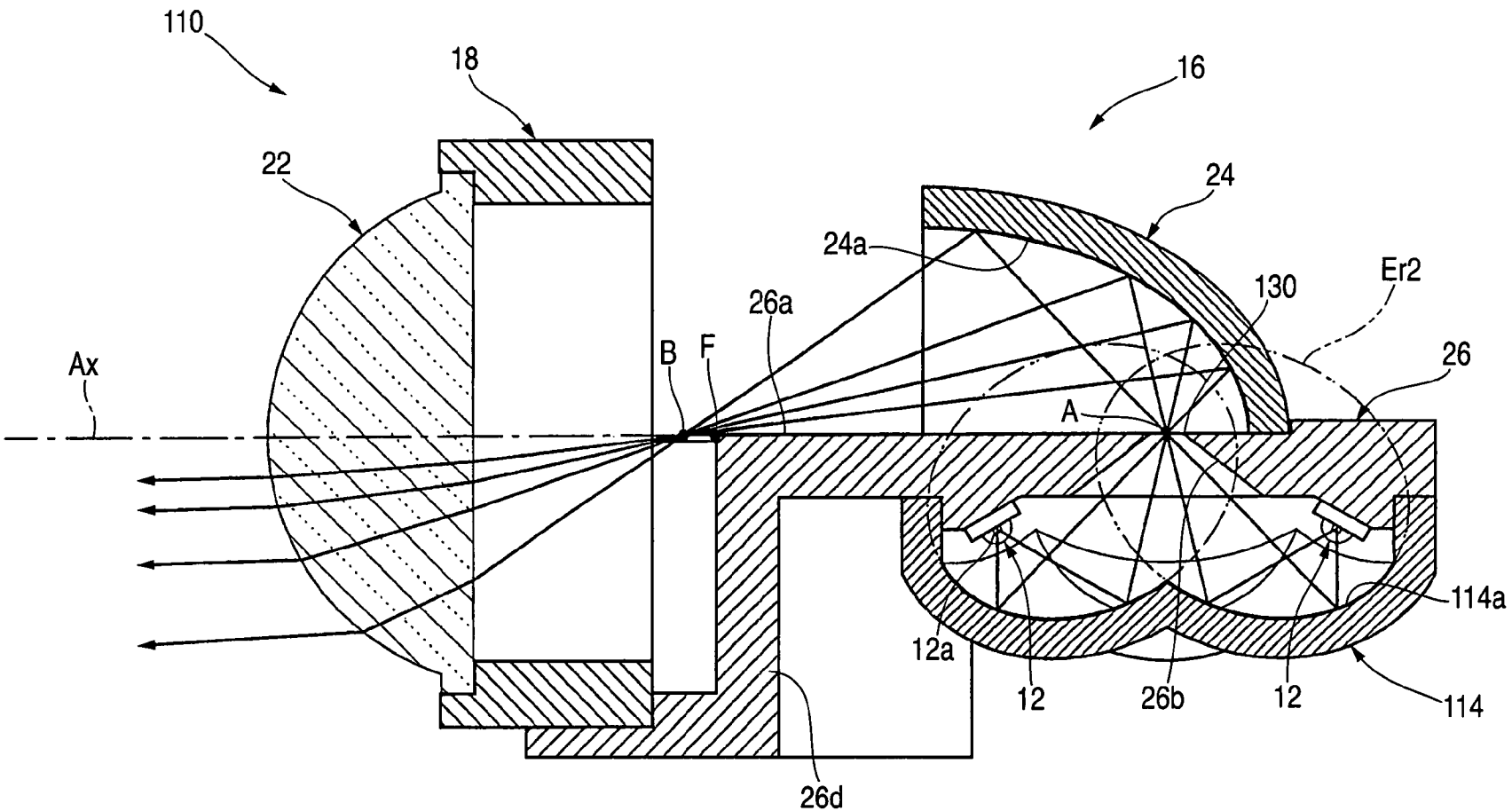
FIG. 6 is a drawing similar to FIG. 1, which shows a vehicular illumination lamp according to a first modification to the exemplary embodiment.

Firstly, a first modification to the exemplary embodiment will be described. FIG. 6 is a similar drawing to FIG. 1, which shows a vehicular illumination lamp according to the modification.

As shown in FIG. 6, in this modification, while the configurations of a light distribution control member 16 and respective light emitting devices 12 are similar to those of their counterparts in the exemplary embodiment, the configuration of a reflector 114 and the arrangement of the four light emitting devices 12 are different from those of their counterparts in the exemplary embodiment.

This modification is similar to the exemplary embodiment in that these four light emitting devices 12 are disposed on the same circumference centered at a vertical axis which passes a predetermined point A at intervals of 90° but is different in that these respective light emitting devices 12 are disposed in such a manner as to be oriented obliquely downwardly so as to be directed to the vertical axis at positions which are further below the corresponding positions in the exemplary embodiment.

In addition, while it is true that the reflector 114 of the modification has four reflecting surfaces 114*a* that are made up of ellipsoids of revolution Er2, which take light emitting centers of the respective light emitting devices 12 and the predetermined point A as primary focal points and secondary focal points thereof, respectively, the ellipsoids of revolution Er2 are smaller than the ellipsoids of revolution Er1 in the exemplary embodiment, and the eccentricity thereof is a larger value than the eccentricity of the exemplary embodiment. Therefore, the reflector 114 is made more compact in size than the reflector 14 in the exemplary embodiment.

In this modification, in line with the fact that the arrangement of the four light emitting devices 12 and the configuration of the reflector 114 are different from the embodiment, the shape of a lower surface of a mirror member 26 differs from that of the counterparts in the exemplary embodiment. Note that in this modification, an aperture stop 130 also is provided in an upper surface of the mirror member 26 in such a manner as to surround the predetermined point A.

Also, when the configuration of the modification is adopted, the same functions and advantages as those of the exemplary embodiment can be obtained. Moreover, in this modification, since the reflector 114 can be made more compact in size, the reduction in the overall size of the vehicular illumination lamp 110 can be realized.

Figure 7:
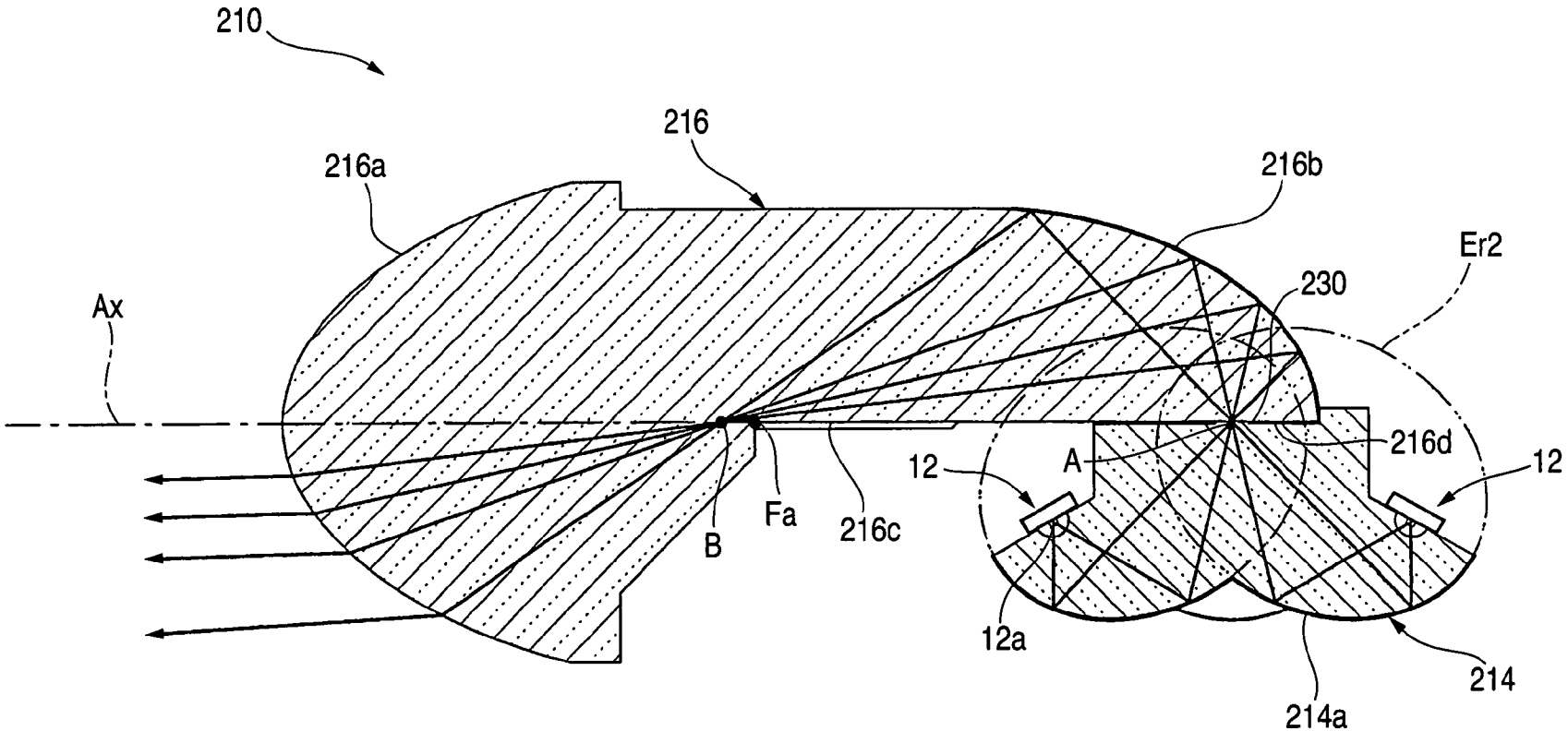
FIG. 7 is a drawing similar to FIG. 1, which shows a vehicular illumination lamp according to a second modification to the exemplary embodiment.

Next, a second modification to the embodiment will be described. FIG. 7 is a similar drawing to FIG. 1, which shows a vehicular illumination lamp 210 according to this modification.

As shown in FIG. 7, this modification is similar to the first modification in that the configuration and arrangement of four light emitting devices 12 are similar to those of the corresponding devices in the first modification but is different in that either of a reflector 214 and a light distribution control member 216 is made up of a transparent resin light transmitting block.

Namely, as with the reflector 114 of the first modification, the reflector 214 of this modification has four reflecting surfaces 214*a* that are made up of ellipsoids of revolution Er2, which take light emitting centers of the respective light emitting devices 12 and a predetermined point A as primary focal points and secondary focal points thereof, respectively. In this case, while the arrangement and shape of the respective reflecting surfaces 214*a* are the same as those of the reflecting surfaces 114*a* of the first modification, each reflecting surface 214*a* is formed by applying a planishing treatment to a surface of the light transmitting block to provide a mirror reflection effect. The planishing treatment includes the deposition or spray of aluminum.

In addition, while the light distribution control member 216 of this modification has the same light distribution function as that of the light distribution control member 16 of the first modification, in this modification, the projection lens 22, the additional reflector 24 and the mirror member 26 of the first modification are made into an integral unit as a single light transmitting block.

Namely, in this light distribution control member 216, a projection lens surface 216*a* is formed on a front surface of the light transmitting block, an additional reflector surface 216*b* is formed on an upper surface of a rear portion of the light transmitting block, and a mirror surface 216*c* and a reflector mounting surface are formed on a lower surface of the light transmitting block.

The projection lens surface 216*a* is made up of an ellipsoid of revolution, which takes an optical axis Ax as a center axis, and the eccentricity thereof is set to the inverse of a number of the refractive index of a transparent resin making up the light transmitting block. Then, by this configuration, this projection lens surface 216*a* causes light which has reached the relevant projection lens surface 216*a* from a rear focal point Fa of a pair of front and rear focal points of the ellipsoid of revolution thereof to emerge towards the front of the lamp as parallel light to the optical axis Ax. As this occurs, the focal point Fa is set to the same position as that of the rear focal point F of the projection lens 22 of the first modification.

The additional reflector surface 216*b* is made up of a spherical surface which covers the predetermined point A from thereabove, and the shape of a surface thereof is identical to a reflecting surface 24*a* of an additional reflector 24 in the first modification. In this case, this additional reflector surface 216*b* is formed by applying to a surface of the light transmitting block a planishing treatment including the deposition or spray of aluminum to provide a mirror reflection effect.

The mirror surface 216*c* is made up of a stepped plane which extends rearwards from the focal point Fa of the projection lens surface 216*a* along the optical axis Ax, and the shape of a surface thereof is identical to an upwardly oriented reflecting surface 26*a* of the mirror member 26 in the first modification. In this case, the mirror surface 216*c* is adapted to reflect upwards part of reflected light traversing from the additional reflector surface 216*b* to the projection lens surface 216*a* by virtue of total reflection. A front end edge of the mirror surface 216*c* is formed in such a manner as to extend along a focal plane which contains the focal point Fa of the projection lens surface 216*a*.

The reflector mounting surface 216*d* is made up of a horizontal plane which contains the optical axis Ax, and an aperture stop 230 is provided in a surface thereof in such a manner as to surround the predetermined point A. This aperture stop 230 is formed by applying, to portions other than the aperture stop 230 on the reflector mounting surface 216*d*, a planishing treatment including the deposition or spray of aluminum to provide a mirror reflection effect.

In the reflector 214, an upper end surface of the light transmitting block making up the reflector 214 is made up of a horizontal plane which contains the predetermined point A, and the reflector 214 is fixedly positioned to the light distribution control member 216 in such a manner that the upper end surface is tightly joined to the reflector mounting surface 216*d*.

Then, in this modification, as in the case with the first modification, light from the respective light emitting devices 12 that is reflected on the respective reflecting surfaces 214*a* of the reflector 214 is first caused to converge temporarily on the predetermined point A so as to be made to be incident on the additional reflector surface 216*b* as diffused light from the predetermined point A, and the light is then reflected towards the front of the lamp by the additional reflector surface 216*b* while causing the light to get closer to the optical axis Ax. Then, part of the light so reflected is reflected upwards on the mirror surface 216*c* so as to reach the projection lens surface 216*a*. As this occurs, stray light contained in the reflected light which travels from the reflector 214 to the light distribution control member 216 is designed to be removed by the aperture stop 230.

Also when the configuration of this modification is adopted, the same functions and advantages as those of the first modification can be obtained. For example, a light distribution pattern which has a clear cut-off line at an upper end portion thereof can be formed, while enhancing the utilization factor of bundles of rays of light from the plurality of light emitting devices.

Moreover, in this modification, since the reflector 214 and the light distribution pattern control member 216 are made up of the transparent resin light transmitting block, the vehicular illumination lamp 210 can be made much more compact than the vehicular illumination lamp 110 according to the first modification.

In addition, while in the first modification, when reflected light from the additional reflector 24 is incident on the projection lens 22, some light reflection occurs on a rear surface of the projection lens 22, such a risk of the occurrence of light reflection can be eliminated in this modification, whereby the utilization factor of bundles of rays of light from the four light emitting devices 12 can be enhanced further.

Note that while this modification has been described with the reflector 214 and the light distribution control member 216 being made up of the separate light transmitting blocks, the reflector 214 and the light distribution control member 216 can be made up of a single light transmitting block.

Figure 8:
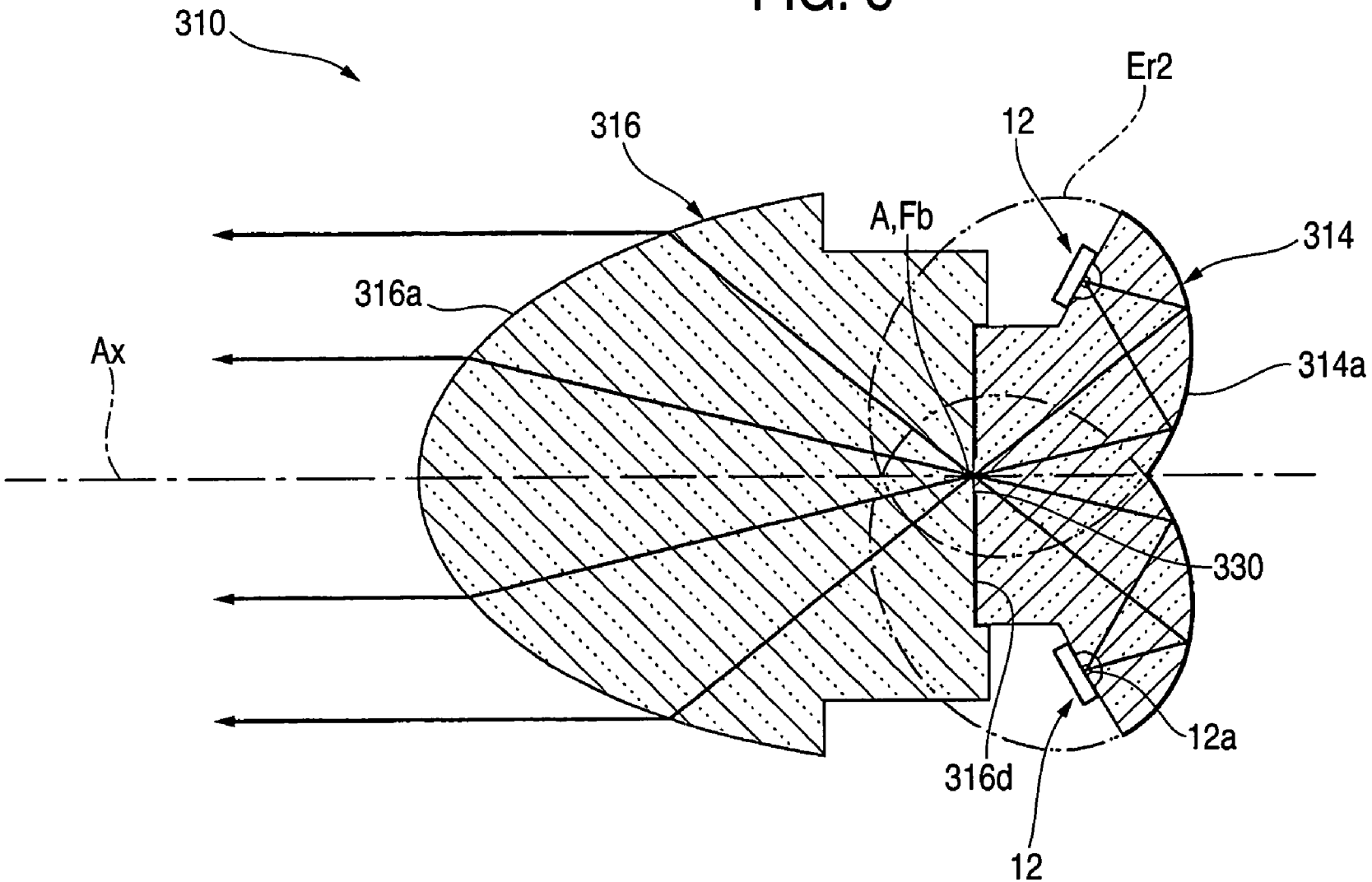
FIG. 8 is a drawing similar to FIG. 1, which shows a vehicular illumination lamp according to a third modification to the exemplary embodiment.

Next, a third modification to the exemplary embodiment will be described. FIG. 8 is a similar drawing to FIG. 1, which shows a vehicular illumination lamp 310 according to this modification, and FIG. 9 is a plan sectional view thereof.

Figure 9:
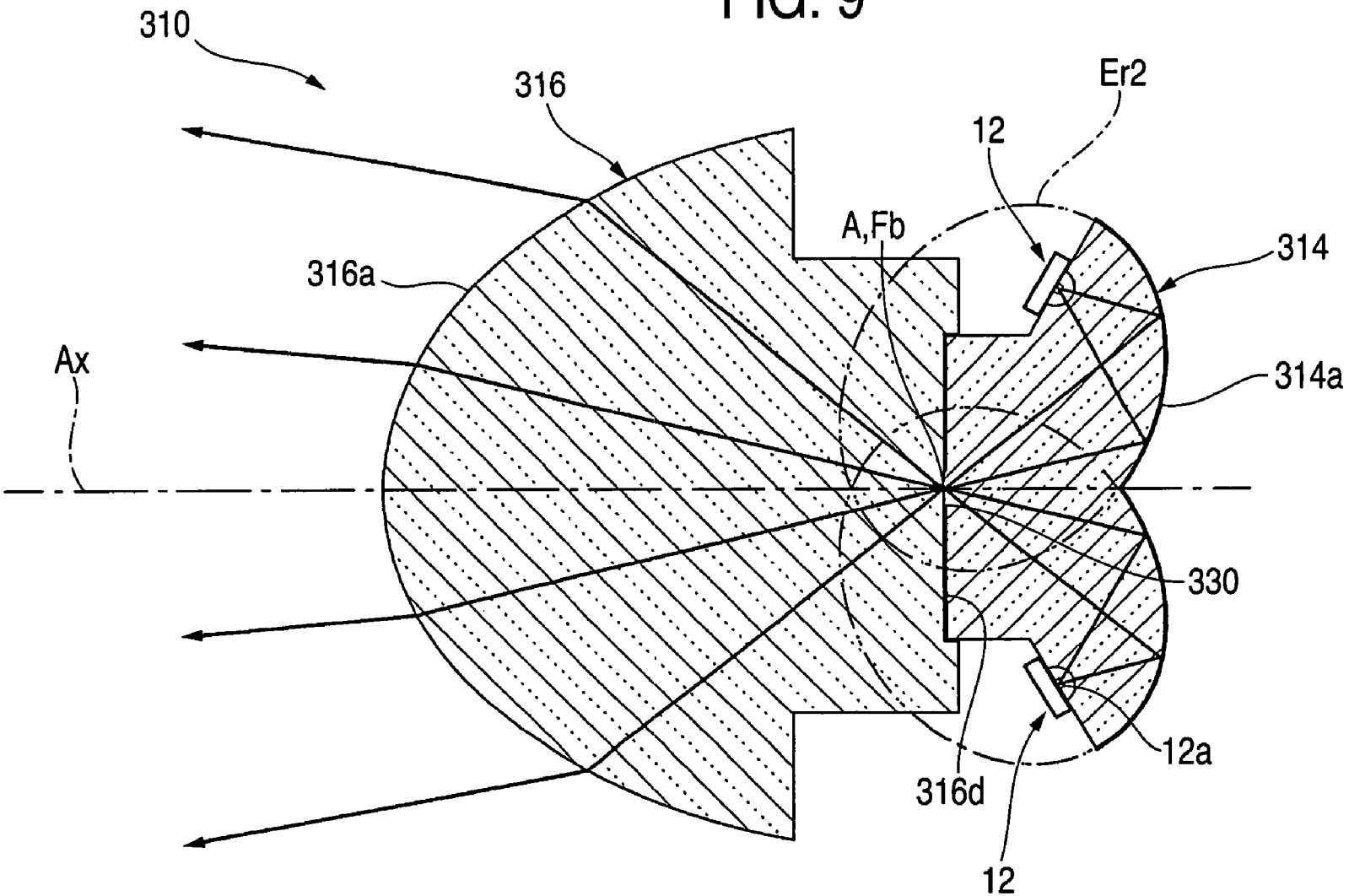
FIG. 9 is a plan sectional view which shows the vehicular illumination lamp according to the third modification.

As shown in FIGS. 8 and 9, in this modification, while the configurations of four light emitting devices 12 and a reflector 314 are similar to those of their counterparts in the second modification, the arrangement of the reflector 314 and the configuration of the light distribution control member 316 differ from that of its counterpart in the second modification.

Namely, the reflector 314 of this modification is disposed in such a manner as to be directed to the front of the lamp with a predetermined point A made to be positioned on an optical axis Ax.

In addition, while the light distribution control member 316 is made up of a transparent resin light transmitting block as in the case with the reflector 214 of the second modification, an optical function thereof differs from that of the reflector 214. Namely, on this light distribution control member 316, a projection lens surface 316*a* is formed on a front surface of the light transmitting block, and a reflector mounting surface 316*d* is formed on a rear surface of the light transmitting block.

The projection lens surface 316*a* is made up of an ellipsoid which takes the optical axis Ax as a center axis and which is slightly flat in a vertical direction. In this case, the eccentricity of an ellipse which makes up a vertical sectional shape which contains the optical axis Ax is set to the inverse of a number of the refractive index of a transparent resin constituting the light transmitting block. Then, by this configuration, this projection lens surface 316*a* is made to cause light which has reached the relevant projection lens surface 316*a* from a rear focal point Fb of a pair of front and rear focal points of the ellipsoid of revolution thereof not only to emerge towards the front of the lens as parallel light to the optical axis Ax with respect to a vertical direction but also to emerge towards the front of the lamp as light which is diffused to some extent in a horizontal direction. As this occurs, the focal point Fb is set to the same position as that of the predetermined point A.

The reflector mounting surface 316*d* is made up of a vertical surface which intersects with the optical axis Ax at right angles in such a manner as to contain the predetermined point A, and an aperture stop 330 is provided in a surface thereof. This aperture stop 330 is formed by applying, to portions other than the aperture stop 330 on the reflector mounting surface 316*d*, a planishing treatment including the deposition or spray of aluminum to provide a mirror reflection effect.

The reflector 314 is fixedly positioned to the light distribution control member 316 in such a manner that a front end surface made up of the vertical surface containing the predetermined point A is tightly joined to the reflector mounting surface 316*d*.

Then, in this modification, light from the respective light emitting devices 12 that is reflected on respective reflecting surfaces 314*a* of the reflector 314 is first caused to converge temporarily on the predetermined point A and is then caused to reach the projection lens surface 316*a* as diffused light from the predetermined point A. As this occurs, stray light contained in the reflected light traveling from the reflector 314 to the light distribution control member 316 is made to be removed by the aperture stop 330.

Figure 10:
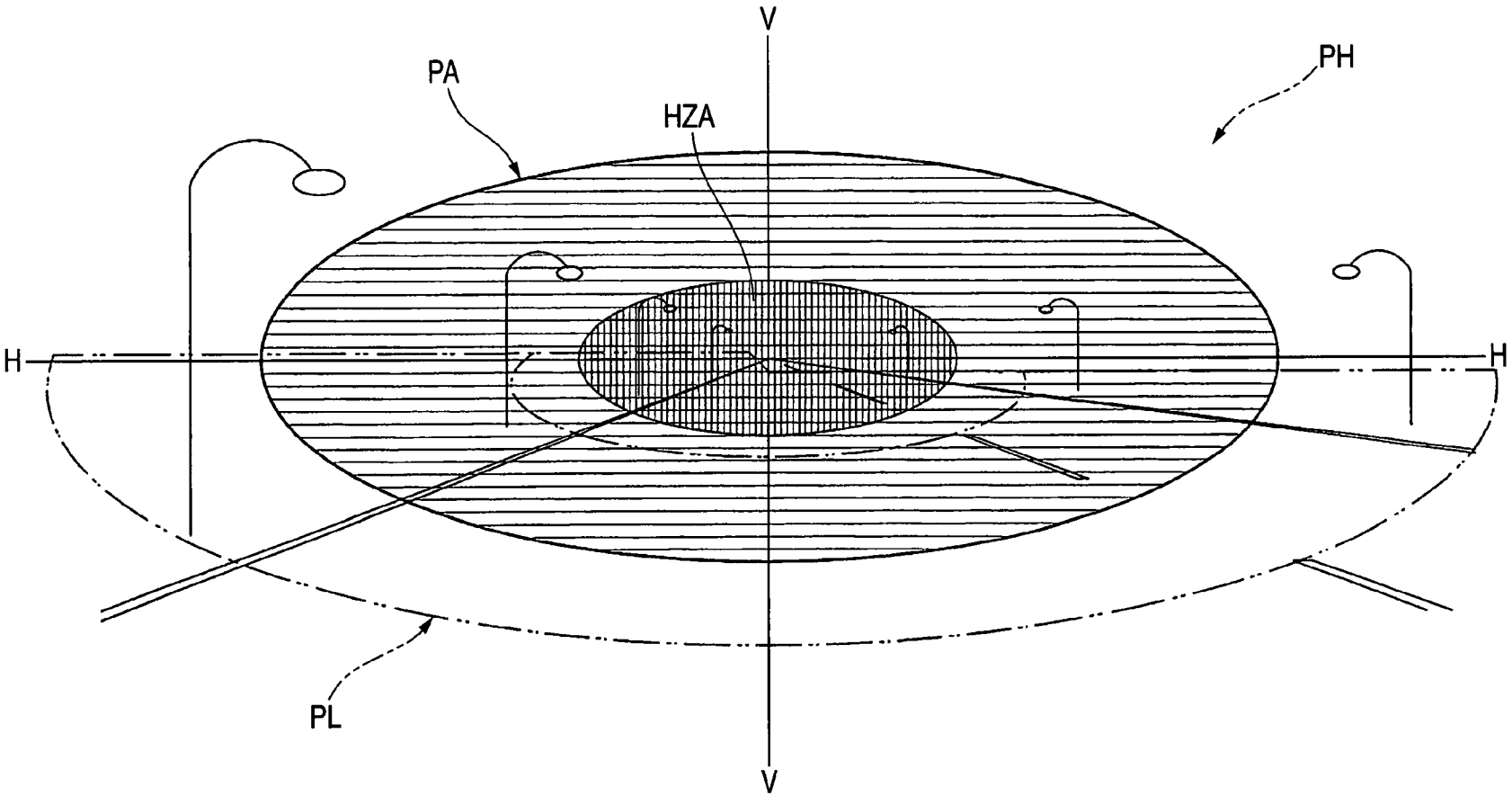
FIG. 10 is a perspective view of a light distribution pattern that is to be formed by light emitted forwards from the vehicular illumination lamp according to the third modification on the imaginary vertical screen disposed 25 m ahead of the vehicle.

FIG. 10 is a perspective view which shows a light distribution pattern PA that is formed by light emitted forwards from the vehicular illumination lamp 310 according to this modification on an imaginary vertical screen disposed 25 m ahead of the vehicle.

As shown in the same figure, this light distribution pattern PA is an additional upper beam forming light distribution pattern designed to form an upper beam light distribution pattern by being combined with a lower beam light distribution pattern PL.

This additional upper beam forming light distribution patter PA is formed as a light distribution pattern, which spreads in the transverse direction about an H-V point as a center. As this occurs, this additional upper beam forming light distribution pattern PA is formed as a light distribution pattern which is slightly smaller than the lower beam light distribution pattern and a hot zone constituting a high luminous intensity area is formed around the H-V point as a center therein.

The reason why this additional upper beam forming light distribution pattern is formed as the light distribution pattern which spreads in the transverse direction is because the projection lens surface 316*a* of the light distribution control member 16 is made up of the ellipsoid which is slightly flat in the vertical direction.

Also when the configuration of this modification is adopted, the brightness of the additional upper beam forming light distribution PA formed by light emitted from the vehicular illumination lamp 310 can be secured sufficiently, whereby the number of such vehicular illumination lamps required when the vehicular illumination lamp 310 is attempted to be used for a headlamp can be set to a smaller number.

Moreover, in this modification, as in the case with the second modification, since the reflector 314 and the light distribution control member 316 are made up of the transparent, resin light transmitting blocks and moreover, the light distribution control member 316 is made as an optical member having only the lens function, the vehicular illumination lamp 310 can be made much more compact in size than the vehicular illumination lamp 210 according to the second modification.

In addition, also in this modification, it is possible to prevent the occurrence of the risk, inherent in the exemplary embodiment or the first modification, that light reflection is generated on the rear surface of the projection lens 22 when reflected light from the additional reflector 24 is incident on the projection lens 22. Accordingly, the utilization factor of bundles of rays of light from the four light emitting devices 12 can be enhanced further.

While the invention has been described with reference to the exemplary embodiment and modifications thereof, the technical scope of the invention is not restricted to the description of the exemplary embodiment and modifications thereof. It is apparent to the skilled in the art that various changes or improvements can be made. It is apparent from the description of claims that the changed or improved configurations can also be included in the technical scope of the invention.

What is claimed is:

1. A vehicular illumination lamp, comprising;

a plurality of light emitting devices, the plurality of light emitting devices disposed about a predetermined center point;

a reflector comprising a plurality of reflecting surfaces, each of the reflecting surfaces comprising an ellipsoid of revolution comprising a primary focal point near a respective light emitting device of the plurality of light emitting devices and a secondary focal point at the predetermined center point; and a light distribution control member for controlling the distribution of light from the respective light emitting devices that is reflected on the reflector, the light distribution control member causing the light so controlled to travel to a front of the lamp.

2. The vehicular illumination lamp as set forth in claim 1, wherein the plurality of light emitting devices are disposed around a circumference of an axis that passes through the predetermined center point, the plurality of light emitting device being disposed circumferentially at substantially equal intervals with respect to the axis.

3. The vehicular illumination lamp as set forth in claim 1, wherein an aperture stop of a predetermined diameter is provided between the reflector and the light distribution control member, and aperture stop surrounding the predetermined point.

4. The vehicular illumination lamp as set forth in claim 1, wherein at least one of the reflector and the light distribution control member is made up of a light transmitting block.

5. The vehicular illumination lamp as set forth in claim 1, wherein the reflector is oriented upwards, and wherein the light distribution control member comprises:

a projection lens disposed on an optical axis, which extends in a longitudinal direction of the lamp such that a rear focal point of the projection lens lies further forwards than the predetermined point, and an additional reflector provided above the predetermined point and adapted to reflect light, from the respective light emitting devices that is reflected on the reflector, towards the front of the lamp and closer to the optical axis.

6. The vehicular illumination lamp as set forth in claim 5, wherein the light distribution control member comprises:

a mirror member comprising an upwardly oriented reflecting surface, which extends rearwards from near the rear focal point of the projecting lens substantially along the optical axis, the reflecting surface reflects part of reflected light from the additional reflector upwards.

7. The vehicular illumination lamp as set forth in claim 5, wherein a reflecting surface of the additional reflector comprises a substantially ellipsoidal surface, which has a major axis that is coaxial with the optical axis and takes a predetermined point as a primary focal point thereof.

8. The vehicular illumination lamp as set forth in claim 6, wherein a front end edge of the upwardly oriented reflecting surface of the mirror member is formed in such a manner as to extend along a focal plane containing the rear focal point of the projection lens.

9. The vehicular illumination lamp as set forth in claim 7, wherein the light distribution control member comprises:

a mirror member comprising an upwardly oriented reflecting surface, which extends rearwards from near the rear focal point of the projecting lens substantially along the optical axis, the reflecting surface reflects part of reflected light from the additional reflector upwards.

10. The vehicular illumination lamp as set forth in claim 9, wherein a front end edge of the upwardly oriented reflecting surface of the mirror member is formed in such a manner as to extend along a focal plane containing the rear focal point of the projection lens.

11. The vehicular illumination lamp as set forth in claim 1, wherein each light emitting device is a white light emitting diode.

12. The vehicular illumination lamp as set forth in claim 2, wherein an aperture stop of a predetermined diameter is provided between the reflector and the light distribution control member, and aperture stop surrounding the predetermined point.

13. The vehicular illumination lamp as set forth in claim 12, wherein at least one of the reflector and the light distribution control member is made up of a light transmitting block.

14. The vehicular illumination lamp as set forth in claim 13, wherein the reflector is oriented upwards, and wherein the light distribution control member comprises:

a projection lens disposed on an optical axis, which extends in a longitudinal direction of the lamp such that a rear focal point of the projection lens lies further forwards than the predetermined point, and an additional reflector provided above the predetermined point and adapted to reflect light, from the respective light emitting devices that is reflected on the reflector, towards the front of the lamp and closer to the optical axis.

15. The vehicular illumination lamp as set forth in claim 14, wherein the light distribution control member comprises:

a mirror member comprising an upwardly oriented reflecting surface, which extends rearwards from near the rear focal point of the projecting lens substantially along the optical axis, the reflecting surface reflects part of reflected light from the additional reflector upwards.

16. The vehicular illumination lamp as set forth in claim 14, wherein a reflecting surface of the additional reflector comprises a substantially ellipsoidal surface, which has a major axis that is coaxial with the optical axis and takes a predetermined point as a primary focal point thereof.

17. The vehicular illumination lamp as set forth in claim 15, wherein a front end edge of the upwardly oriented reflecting surface of the mirror member is formed in such a manner as to extend along a focal plane containing the rear focal point of the projection lens.

18. The vehicular illumination lamp as set forth in claim 13, wherein each light emitting device is a white light emitting diode.

* * * * *